US008239985B2

(12) United States Patent
Christensen et al.

(10) Patent No.: US 8,239,985 B2
(45) Date of Patent: Aug. 14, 2012

(54) TOWEL WITH ONE OR MORE RECESSED POCKETS

(76) Inventors: Joshua P. Christensen, Draper, UT (US); Michael G. Ware, San Francisco, CA (US)

( * ) Notice: Subject to any disclaimer, the term of this patent is extended or adjusted under 35 U.S.C. 154(b) by 0 days.

(21) Appl. No.: 12/771,655

(22) Filed: Apr. 30, 2010

(65) Prior Publication Data

US 2011/0268930 A1 Nov. 3, 2011

(51) Int. Cl.
*A47G 9/06* (2006.01)

(52) U.S. Cl. ..... 5/417; 5/922

(58) Field of Classification Search ..... 5/417–420, 5/485, 922, 931
See application file for complete search history.

(56) References Cited

U.S. PATENT DOCUMENTS 4,654,906 A * 4/1987 Roberts ..... 5/417
4,656,670 A 4/1987 Schluter
5,018,229 A 5/1991 Eberhart
5,072,467 A 12/1991 Hunt
5,346,308 A 9/1994 Buhot et al.
5,361,435 A 11/1994 Reeves
5,406,659 A 4/1995 Camp
5,443,880 A 8/1995 Wike
5,622,300 A * 4/1997 Robinson ..... 224/575
5,729,846 A 3/1998 Sullivan
5,843,556 A * 12/1998 Levas ..... 428/99
6,192,536 B1 2/2001 Connors
2005/0236450 A1 10/2005 Iannini
2010/0017960 A1* 1/2010 Blaauboer et al. ..... 5/417

* cited by examiner

*Primary Examiner* — Fredrick Conley
(74) *Attorney, Agent, or Firm* — Austin Rapp & Hardman

(57) ABSTRACT

A towel with one or more recessed pockets is disclosed. A first peripheral edge spans from a first corner of the towel to a second corner of the towel. A second peripheral edge spans from a third corner of the towel to a fourth corner of the towel. The second peripheral edge is positioned generally opposite the first peripheral edge of the towel. A first recessed pocket includes a first set of openings is disposed on and coextensive with the first peripheral edge. A second recessed pocket includes a second set of openings disposed on and coextensive with the second peripheral edge. A first liner covers an interior surface of the first recessed pocket. A second liner covers an interior surface of the second recessed pocket. The first and second liner each comprise rounded interior corners.

7 Claims, 10 Drawing Sheets

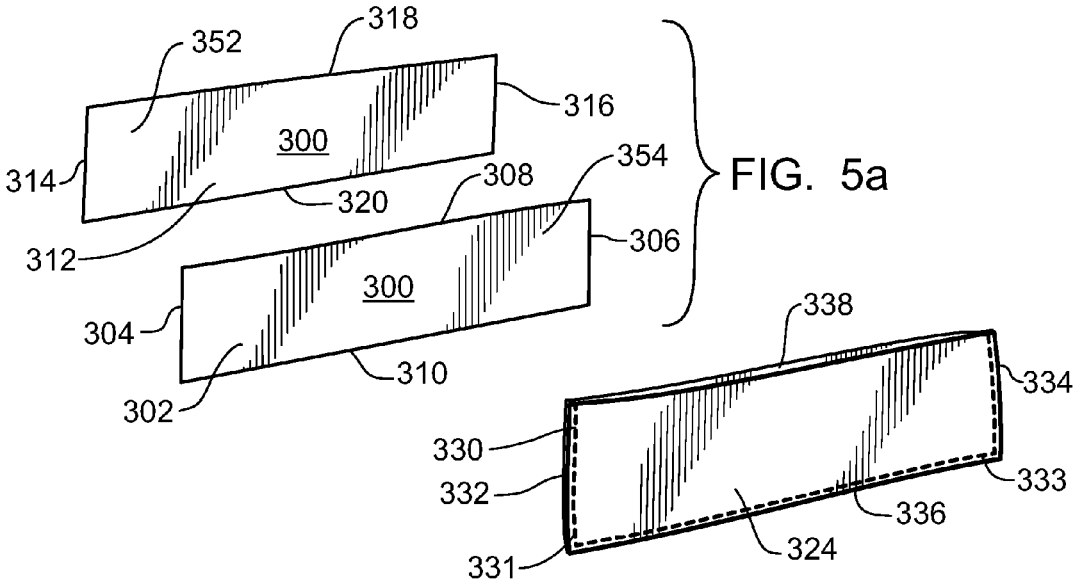
FIG. 5a
FIG. 5b
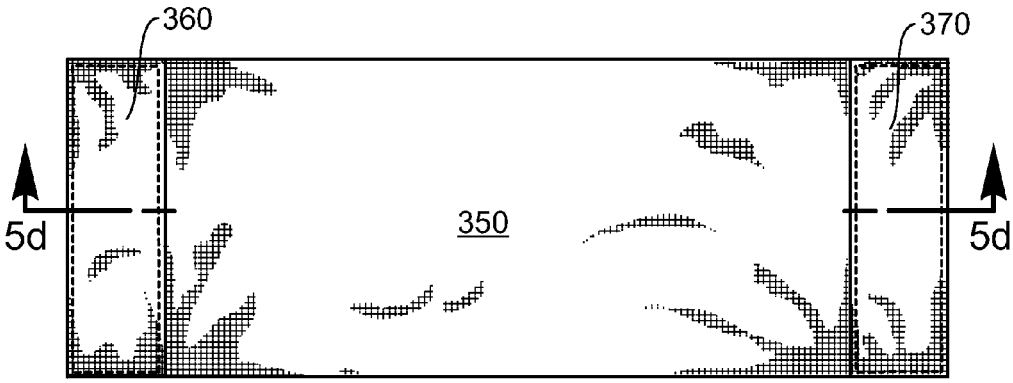
FIG. 5c
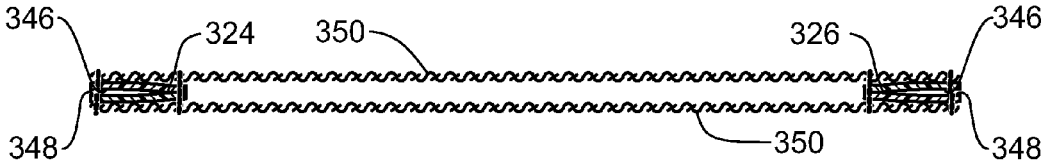
FIG. 5d

TOWEL WITH ONE OR MORE RECESSED POCKETS

TECHNICAL FIELD

The present invention relates generally to textiles. More specifically, the present invention relates to towels.

BACKGROUND

While towels have been available for some time, conventional towels suffer from a number of shortcomings. For example, towels are often utilized in a beach setting where breezes and sometimes strong winds are frequently present. Under these conditions, the towel can easily be blown away, for example, into a nearby lake or ocean. A user is often compelled to spend time searching for available objects, such as a rock or cooler, to rest on the towel to prevent it from being blown away. Unfortunately, these objects are often ineffective as a breeze may still elevate and cause a portion of the towel to fold over on to itself. In addition, a user is often hard pressed to find enough objects to position on the towel without diminishing the available space on the towel for a person, or encumbering a person's range of movement on the towel. Also, the direction of these breezes or winds may change, making it even more difficult to keep the towel from blowing away.

Accordingly, an improved towel that addresses these or other shortcomings is desirable.

BRIEF DESCRIPTION OF THE DRAWINGS

Exemplary embodiments of the invention will become more fully apparent from the following description and appended claims taken in conjunction with the accompanying drawings. Understanding that these drawings depict only exemplary embodiments and are, therefore, not to be considered limiting of the invention's scope, the exemplary embodiments of the invention will be described with additional specificity and detail through use of the accompanying drawings in which:

FIGS. 5*a-d* illustrate an alternative method by which one embodiment of the present invention may be fabricated;

DETAILED DESCRIPTION

Figure 1:
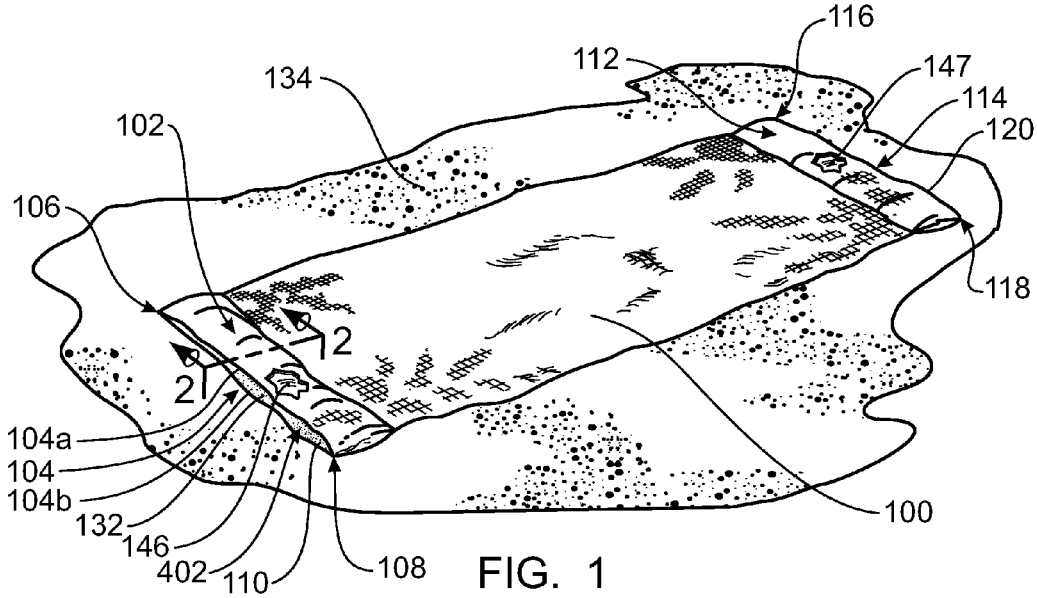
FIG. 1 is a perspective view of one embodiment of a towel of the present invention.

A towel having one or more recessed pockets is disclosed. The towel may comprise a first peripheral edge spanning from a first corner of the towel to a second corner of the towel, and a second peripheral edge spanning from a third corner of the towel to a fourth corner of the towel. The towel may further comprise the second peripheral edge being positioned generally opposite the first peripheral edge of the towel. A first recessed pocket having a first set of openings may be disposed on and coextensive with the first peripheral edge. A second recessed pocket having a second set of openings may be disposed on and coextensive with the second peripheral edge. A first liner may cover an interior surface of the first recessed pocket, and a second liner may cover an interior surface of the second recessed pocket, the first and second liner each comprising rounded interior corners.

In one embodiment, the first set of openings comprises a single opening or, alternatively, two or more openings. The first liner may comprise at least two compartments, each compartment comprising a pair of rounded corners and corresponding to a single one of the two or more openings.

Each recessed pocket may comprise a permanent attachment mechanism for attaching each of the recessed pockets to a main body of the towel. The towel may further comprise a permanent securing mechanism for securing portions of opposite sides of the first recessed pocket to each other.

A towel material may cover the first liner such that the first liner is not visible unless at least one opening of the first set of openings is in an open position.

A method of using the towel is also disclosed. The method may involve providing a weighting material in each of the recessed pockets, and raising a central portion of the towel such that the first and second set of openings generally face downward and an axis of each of the first and second recessed pockets is generally perpendicular to a ground plane to enable a force of gravity to direct the weighting material out of each of the first and second recessed pockets. The weighting material may primarily comprise sand, dirt, rocks, or a mixture thereof.

A method of manufacturing on embodiment of the first recessed pocket of the towel is also disclosed. This method may include securing to each other two coextensively positioned liner sides generally along a first short edge and a second short edge of each of the liner sides to form the first liner using a securing seam with the securing seam being rounded between each of the first and second short edges of each liner side and a closed long edge of each liner side. The method may also include securing each of two sides of a towel material to opposing surfaces of the first liner along a periphery of a first and second minor edges and a closed major edge of the first liner to form the first recessed pocket with the pieces of towel material having generally the same shape as the first liner.

In one configuration, the two liner sides may comprise a unitary, folded piece of liner material, or each may comprise a separate piece of liner material.

Another method of manufacturing an embodiment of a recessed pocket of the towel is disclosed. This method may include securing to each other two coextensively positioned liner sides generally along a first short edge, a second short edge, and a long closed edge of each of the liner sides to form the first liner using a securing seam with the securing seam being rounded between the first and second short edges of each liner side and the closed long edge of each liner side. The method may also include securing each of two sides of a towel material to two opposing surfaces of the first liner along a periphery of a first and second minor edges of the first liner to form the first recessed pocket. The method may further comprise securing each of two sides of a towel material to two opposing surfaces of the first liner along a periphery of a closed major edge of the first liner to form the first recessed pocket.

A method of manufacturing an embodiment of the towel is disclosed. The method may include securing to each other two coextensively positioned liner sides generally along a first short edge, a second short edge, and along an intermediary region that is generally parallel with the first short edge to form the first liner using a securing seam, the securing seam being rounded between the first and second short edges and the closed long edge of each liner side to form a first and second rounded interior corner, and being rounded between the intermediary region and the closed long edge of each liner side to form a third and fourth rounded interior corner. The method may also include securing each of two sides of a towel material to two opposing surfaces of the first liner along a periphery of a first and second minor edges of the first liner to form the first recessed pocket. This method could also involve securing a distal end of a towel body intermediate the two sides of the towel material. The two liner sides may comprise a separate piece of liner material. The method may further comprise securing the distal end of the towel body intermediate each of the separate pieces of liner material, the distal end of the towel material and each of the separate pieces of liner material being disposed intermediate the two sides of the towel material. The securing seam may extend between the first and third rounded interior corners and between second and fourth rounded interior corners. In one embodiment, the two liner sides comprise a unitary, folded piece of liner material. The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the present invention, as represented in the Figures, is not intended to limit the scope of the invention, as claimed, but is merely representative of presently preferred embodiments of the invention.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

FIG. 1 is a perspective view of one embodiment of a towel 100 of the present invention. More specifically, FIG. 1 illustrates a towel 100 including two recessed pockets 102, 112. The illustrated towel 100 includes a first peripheral edge 104, comprising two edges 104*a-b* surrounding a mouth 402 of the recessed pocket 102, spanning from a first corner 106 of the towel 100 to a second corner 108 of the towel 100. The towel 100 also includes a second peripheral edge 114 spanning from a third corner 116 of the towel 100 to a fourth corner 118 of the towel 100. In the illustrated embodiment, the second peripheral edge 114 is positioned generally opposite the first peripheral edge 104. The towel 100 has a first recessed pocket 102 having a first set of openings 110 disposed on and coextensive with the first peripheral edge 104 of the towel 100. A second recessed pocket 112 having a second set of openings 120 is disposed on and coextensive with the second peripheral edge 114.

A weighting material 132, such as sand, dirt, rocks, or a mixture of the foregoing, may be provided or positioned in one or both of the recessed pockets 102, 112. This weighting material 132, when positioned within the first and second recessed pockets 102, 112, tends to prevent the towel 100 from being blown away or folded over by the wind. Other man-made or natural objects or material (such as a sealed packet of sand) may also be utilized as weighting material 132. Sand or dirt may be advantageous as a weighting material 132 because it is often readily available in a beach setting 134 and also can be simply discarded on to the beach setting 134 after use in connection with the towel 100. Also, sand may also be well suited for use as a weighting material 132 because it is relatively soft and yet dense. Thus, when sand or another similar weighting material 132 is positioned within a recessed pocket 102, 112, this material not only prevents the wind from moving the towel 100, but it also enables the recessed pocket 102, 112 to serve as a pillow or a head or foot rest for a user.

The first recessed pocket 102 may span from the first corner 106 to the second corner 108 of the towel 100, and the second recessed pocket 112 may span from the third corner 116 to the fourth corner 118 of the towel 100. Accordingly, the weighting material 132 may be positioned in corners 106, 108, 116, 118 within the first and second recessed pockets 102, 112, or may be disbursed across the entire length of each pocket 102, 112. In the latter configuration, it is more difficult for the wind to twist or carry the towel 100 away. The weighting material 132 may be positioned within each of the pockets through the respective set of openings 110, 120 in the pockets 102, 112.

An optional liner 146, 147 is positioned within each of these pockets 102, 112. The liner 146, 147 will be discussed below in greater detail in connection with, for example, FIG. 2.

The towel 100 of FIG. 1 is merely illustrative of the disclosed embodiments. For example, in alternative embodiments, one or more recessed pockets 102, 112 could additionally or alternatively be positioned between a first and a third corner 106, 116 of the towel 100 and/or a second and a fourth corner 108, 118 of the towel 100.

Figure 2:
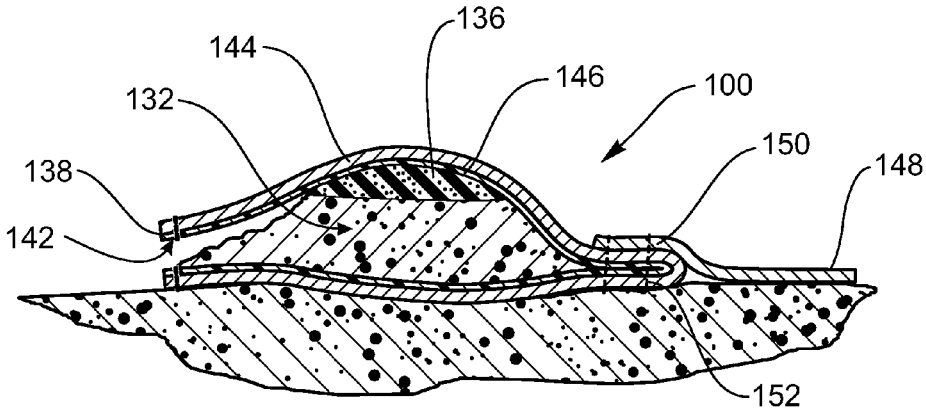
FIG. 2 is cross-sectional view of the embodiment of the towel shown in FIG. 1 across the line 2-2.

FIG. 2 is cross-sectional view of the embodiment of the towel 100 shown in FIG. 1 across the line 2-2. In particular, a cross-sectional view of the first recessed pocket 102 of the towel 100 of FIG. 1 is illustrated in FIG. 2. The recessed pocket 102 may comprise an outer layer 144 and a liner 146. The outer layer 144 may be formed of the same material (such as terry cloth) that the main body 148 of the towel 100 is formed.

The liner 146 is disposed within and covers an interior surface 138 of the recessed pocket 102. The liner 146 may be comprised of a smooth material or a material with a smooth interior surface 142. For example, an interior surface 142 of the liner 146 may be comprised of a material having a low friction coefficient relative to sand such that the material resists adhesion to sand. This enables the sand to easily be removed from a recessed pocket 102, as will be illustrated in connection with FIGS. 3*a-b*.

The liner 146 may be secured to the outer layer 144, utilizing a number of different attachment or securing mechanisms 150, such as stitching, adhesives, ultrasonic welding, or rivets. In one embodiment, a selective or temporary attachment or securing mechanism may be employed such that different liners 146 may be inserted or secured within the outer layer 144. For example, a liner 146 may be inserted into the outer layer 144 using snaps, hooks, zippers, Velcro®, or other temporary attachment mechanisms. Accordingly, in one embodiment, a liner 146 may be pre-configured with a weighting material 132, such as a packet of sand or other types of weighting material 132. Also, the liner 146 may be configured with sand on one portion and a pillow 136 or another soft material with another portion for padding a head or foot of a user. Alternative embodiments are possible in which the liner 146 may also comprise or include a pillow 136, which may be disposed within the liner 146, secured to the liner 146, secured to the outer layer 144 (outside of the liner 146), or simply unattached to the towel 100.

As illustrated, the recessed pocket 102 is secured to the main body 148 of the towel 100 using an attachment mechanism 150. In this case, the attachment mechanism 150 is a permanent attachment mechanism 150, which, as illustrated, comprises stitching 152. Of course, other types of temporary or permanent attachment mechanisms may be utilized, such as adhesives, ultrasonic welding, rivets, snaps, hooks, zippers, Velcro® or combinations of any of the foregoing.

Figure 3A:
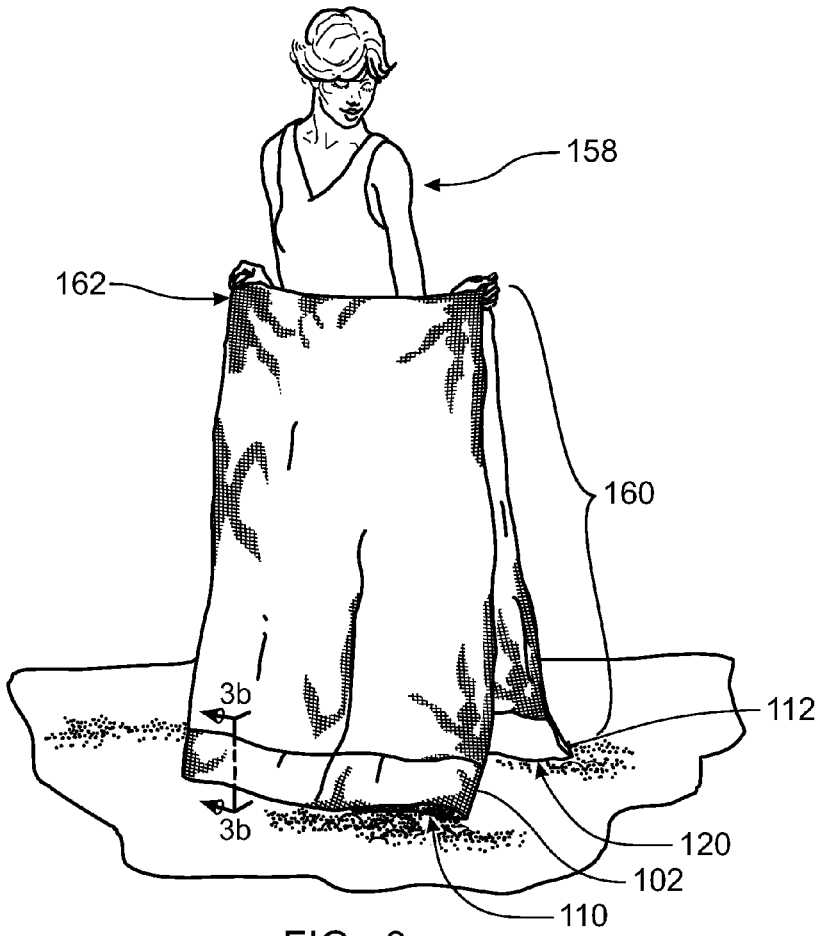
FIG. 3*a* is a perspective view of one embodiment of the towel of FIG. 1 being employed by a user in a removal position.
Figure 3B:
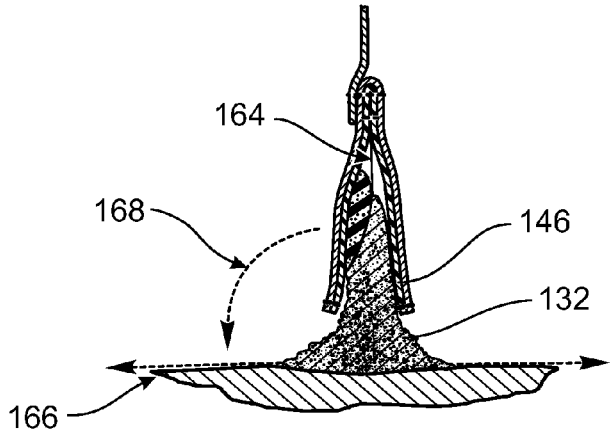
FIG. 3*b* is a cross-sectional view of the towel shown in FIG. 3*a* across the line 3*b*-3*b;*

FIG. 3*a* is a perspective view of one embodiment of the towel 100 of FIG. 1 being employed by a user 158 in a removal position 160. FIG. 3*b* is a cross-sectional view of the towel 100 shown in FIG. 3 across the line 3*b*-3*b* of FIG. 3*a*. FIGS. 3*a* and 3*b* will be discussed jointly. As illustrated in these figures, a user 158 may raise a central portion 162 of the towel 100 such that the first and second set of openings 110, 120 generally face downward. Accordingly, an axis 164 of each of the first and second recessed pockets 102, 112 is positioned generally perpendicular, or at a steep angle, relative to a ground plane 166. This enables the force of gravity to direct the weighting material 132 out of each of the first and second recessed pockets 102, 112. In addition, the use of a liner 146 that is smooth or has a low friction coefficient relative to sand, enables sand, or another weighting material 132, to rapidly exit the recessed pockets 102, 112 in a rapid and convenient fashion when the towel 100 is positioned in the removal position 160, as illustrated in FIGS. 3*a* and 3*b*. Also, if the material from which each liner 146 is made is smooth, the smooth nature of this material mitigates the buildup of sand within the recessed pockets 102, 112, which could subsequently be released or deposited within a user's car, home, or washing machine subsequent to use at a beach setting 134.

As used herein, the term "generally perpendicular" indicates that the axis 164 of the recessed pockets 102, 112 is disposed such that the force of gravity will direct all, most, or a significant portion of the weighting material 132 out of the recessed pockets 102, 112 through the first and second set of openings 110, 120 when the towel 100 is in the removal position 160. For example, in one embodiment, generally perpendicular includes angles 168 such as 90°, 85°, 75°, and 65° between the axis 164 and the ground plane 166.

Figure 4A:
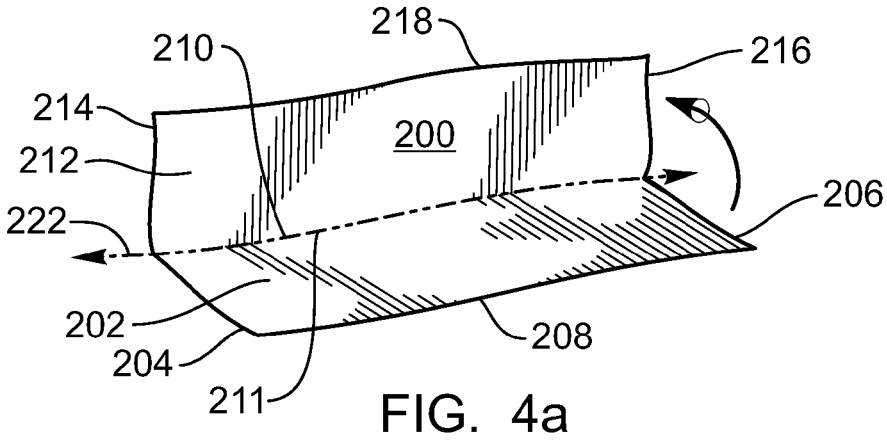
FIGS. 4*a-e* illustrate one method by which one of the embodiments of the present invention may be fabricated.

FIGS. 4*a*-*e* illustrate one embodiment of a method by which one of the configurations of the present invention may be fabricated. As illustrated in the FIG. 4*a*, a liner material 200 may be comprised of two liner sides 202, 212. Each liner side 202, 212 includes a first short edge 204, 214, a second short edge 206, 216, a first (or closed) long edge 210, 211 and a second (or open) long edge 208, 218. As illustrated in FIG. 4*a*, the liner sides 202, 212 may be formed from a unitary piece of liner material 200 folded across a longitudinal axis 222 of the liner material 200.

Figure 4B:
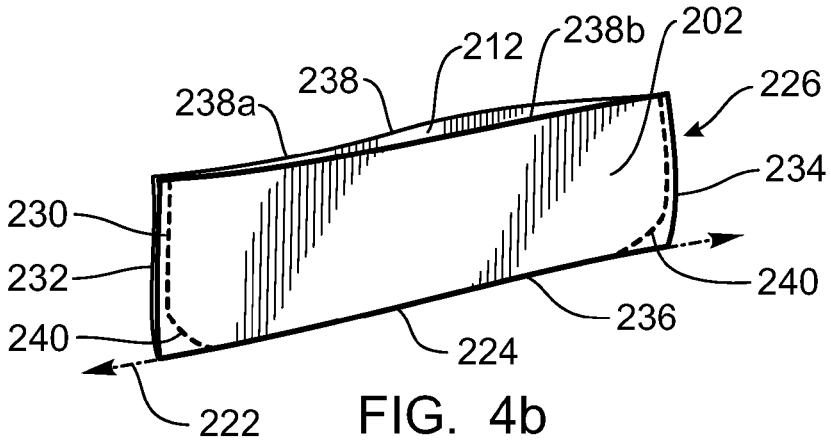

As illustrated in FIG. 4*b*, the rectangular liner sides 202, 212 may be coextensively positioned by folding across the longitudinal axis 222. With reference to FIGS. 4*a*-*b*, coextensively positioned rectangular liner sides 202, 212 may be secured to each other along a first short edge 204, 214 and a second short edge 206, 216 of each of the liner sides 202, 212 to form the liner 224. Various attachment mechanisms 226 may be employed to secure the liner sides 202, 212 to each other, such as stitching or adhesives. The liner 224 includes a first minor edge 232, a second minor edge 234, a first (or closed) major edge 236, and a second (or open) major edge 238, comprising a first and a second edge 238*a*-*b*.

As illustrated in FIGS. 4*a*-*b*, a securing seam 230 is rounded between the first and second short edges 204, 214, 206, 216 and long closed edge 210, 211 of each liner side 202, 212. The rounding of the securing seam 230 creates rounded interior corners 240 within a recessed pocket. These rounded interior corners 240 are beneficial in connection with the towel 100. The rounded interior corners 240 make it more difficult for sand to become lodged within the liner 224, thus enabling the weighting material 132 to more easily and conveniently be discharged from the liner 224 when the towel 100 is placed in a removal position 160 (as shown in FIGS. 3*a*-*b*).

Figure 4C:
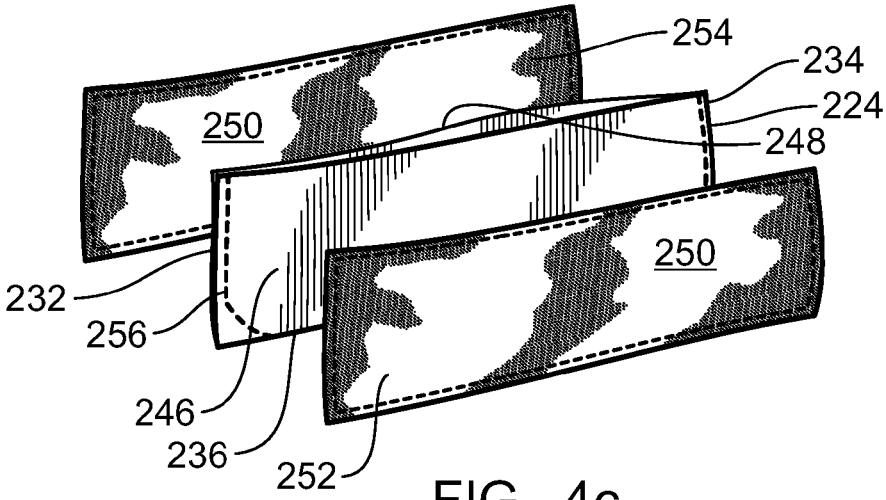

With reference to FIG. 4*c*, two rectangular sides 252, 254 of a towel material 250 are illustrated. As shown in FIG. 4*c*, rectangular sides 252, 254 of the towel material 250 are positioned adjacent to opposing surfaces 246, 248 of the liner 224, to which the rectangular sides 252, 254 of the towel material 250 will be secured.

Figure 4D:
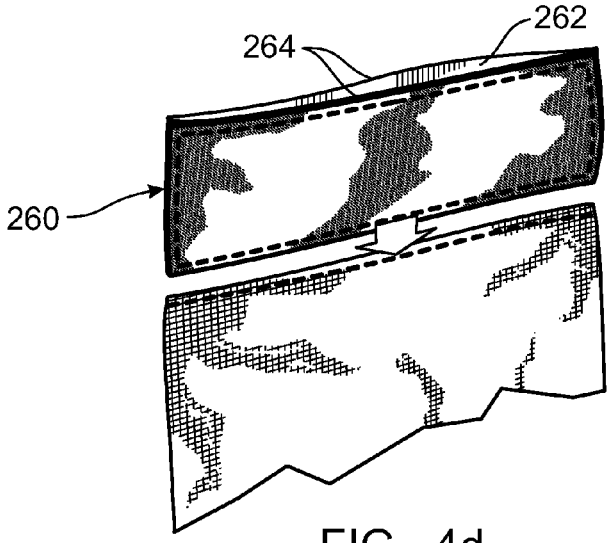

As illustrated in FIG. 4*b*-*d*, two rectangular sides 252, 254 of the towel material 250 may be secured to opposing surfaces 246, 248 of the liner 224 along a periphery 256 of the first and second minor edges 232, 234 and a closed major edge 236 of the liner 224 to form a recessed pocket 260. As shown in FIG. 4*b*-*d*, the rectangular pieces 252, 254 of towel material 250 may have generally the same shape as the liner 224. However, in certain embodiments of the rectangular pieces 252, 254 of towel material 250, while generally having the same shape, are generally larger in dimensions such that the liner 224 is obscured from view unless the set of openings 262 of the recessed pocket 260 is placed in an open position 264, as shown generally in FIG. 4*d*.

Figure 4E:
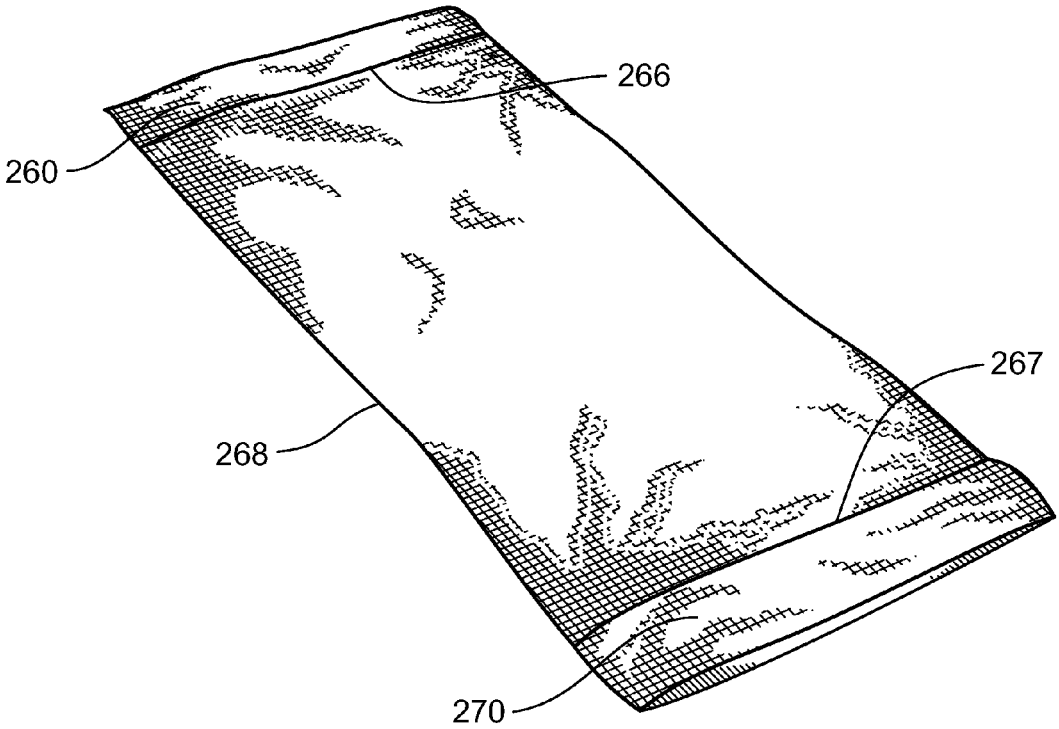

With reference to FIG. 4*e*, one or more recessed pockets 260, 270 may be secured to a towel body. In particular, FIG. 4*e* illustrates a towel body 268 having a first and a second recessed pocket 260, 270 secured to the towel body 268 to form a towel 100. Securing the recessed pockets 260, 270 to the towel body 268 may be achieved using a permanent or a temporary attachment mechanism 266, 267.

FIGS. 5*a*-*d* illustrate an alternative method by which one embodiment of the present invention may be fabricated. FIG. 5*a* illustrates liner sides 302, 312 that each comprise a separate piece of liner material 300. As illustrated in FIG. 5*b*, the liner sides 302, 312 may be secured to each other. Each of the liner sides includes a first short edge 304, 314, second short edge 306, 316, a first long edge 310, 320, and a second long edge 308, 318. Each of the first long edges 310, 320 may be designated as a closed long edge 310, 320, and each of the second long edges 308, 318 may be designated as an open long edge 308, 318. The closed long edges 310, 320, may correspond to a closed end of the liner 324 when the liner sides 302, 312 are assembled to form a liner 324 for a recessed pocket 360 whereas the open long edges 308, 318 may correspond to a set of openings of the recessed pocket 360, as illustrated in FIG. 5*b*.

As shown in FIG. 5*a*-*b*, the liner sides 302, 312 may be coextensively positioned and secured 330 to each other generally along a first short edge 304, 314, a second short edge 306, 316, and a long, closed edge 310, 320 of each liner side 302, 312 to form a liner 324. A securing seam 330 is rounded between the first and second short edges 304, 314, 306, 316 of each liner side 302, 312 and the long closed edge 310, 320 of each liner side 302, 312. As illustrated in FIG. 5*b*, the illustrated seam 330 is formed with rounded corners 331, 333.

Once formed, as shown in FIG. 5*b*, the liner 324 includes a first and a second minor edge 332, 334 and a first (or closed) major edge 336, and a second (or open) major edge 338.

With reference to FIGS. 5*b-d*, two rectangular sides 352, 354 of the towel material 350 may be secured to opposing surfaces 346, 348 of a first and second liner 324, 326 along the periphery of the first and second minor edges 332, 334 of the first liner 324 to form a first and a second recessed pocket 360, 370. In addition, two rectangular sides 352, 354 of the towel material 350 may be secured to the liners 324, 326 along a closed major edge 336 of the first and second liners 324, 326 to form the first and second recessed pockets 360, 370.

FIG. 6*a-d* illustrate alternative embodiments of securing mechanisms for a set of openings of a recessed pocket. In particular, FIGS. 6*a-d* illustrate various embodiments of permanent and temporary securing mechanisms for securing opposite sides, or portions of opposite sides, of a recessed pocket to each other. In some embodiments, these attachment mechanisms may be secured to the recessed pocket at or near a mouth of the recessed pocket.

Figure 6A:
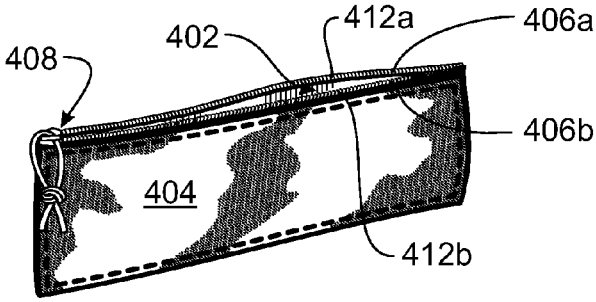
FIG. 6*a-d* illustrate alternative embodiments of attachment mechanisms for a set of openings of a recessed pocket of a towel.

FIG. 6*a* illustrates one embodiment of a temporary securing mechanism 408. This embodiment of the securing mechanism 408 includes mating portions 406*a-b* of a zipper 408 positioned on opposing sides 412*a-b* of a mouth 402 of the illustrated recessed pocket 404. The zipper 408 may be positioned in open, closed, or intermediary positions.

Figure 6B:
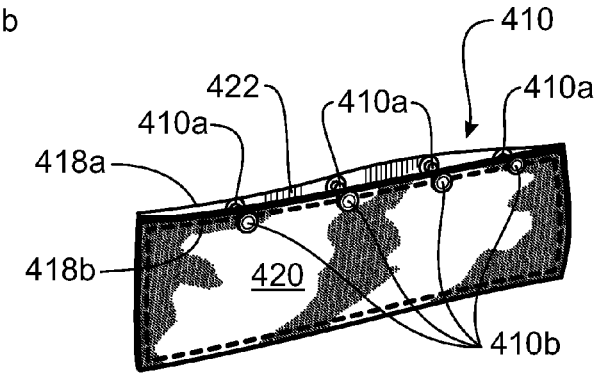

FIG. 6*b* illustrates one embodiment of a temporary securing mechanism 410 including snaps 410*a-b*. In this embodiment, mating portions 410*a-b*, of snaps 410*a-b* are positioned on opposing sides 418*a-b* of a mouth 422 of the illustrated recessed pocket 420. Some or all of the mating portions 410*a* of the snaps 410*a-d* may be secured to the corresponding mating portions 410*b* to close all or a portion of the mouth 422 of the illustrated recessed pocket 420. The number of and positioning of the snaps 410*a-b* may be varied within the scope of the disclosed subject matter.

Figure 6C:
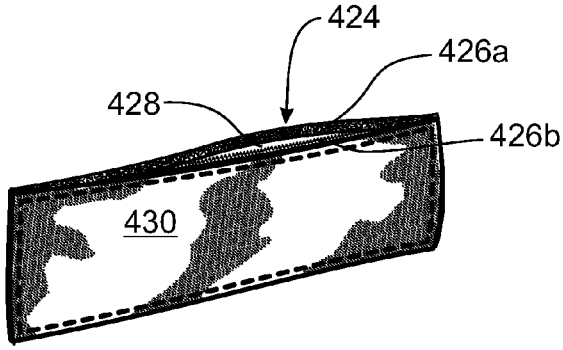

FIG. 6*c* illustrates another embodiment of a temporary securing mechanism 424. This embodiment includes mating strips 426*a-b* of Velcro® 424 positioned along an entire length of a mouth 428 of the recessed pocket 430 to enabling a user to employ Velcro® 424 to entirely or partially close a mouth 428 of the illustrated recessed pocket 430.

Figure 6D:
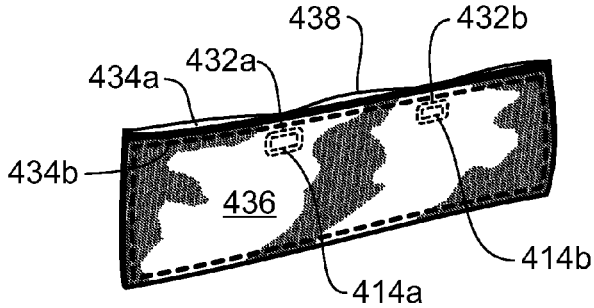

FIG. 6*d* illustrates one embodiment of a permanent securing mechanism 432*a-b*. In this embodiment, opposing sides 434*a-b* of the recessed pocket 436 adjacent to a mouth 438 of the recessed pocket 436 are secured to each other using stitching at various securing locations 414*a-b*. Alternative, permanent securing mechanisms may be employed, such as stitching, rivets, ultrasonic welding, or adhesives. The number of and positioning of the securing locations 414*a-b* may be varied within the scope of the disclosed subject matter. Also, various combinations of temporary and permanent securing mechanisms may be employed within the scope of the disclosed subject matter.

Figure 7A:
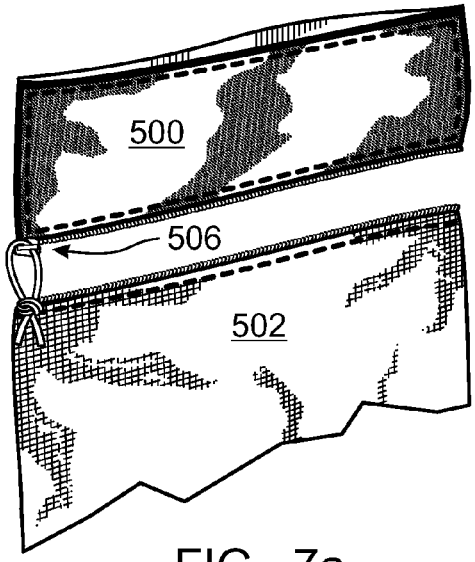
FIGS. 7*a-c* illustrate alternative embodiments of attachment mechanisms for securing a recessed pocket to a main body of a towel.
Figure 7B:
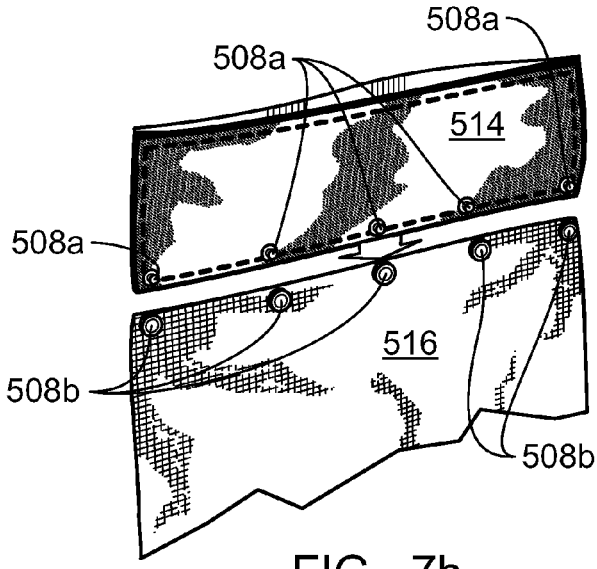
Figure 7C:
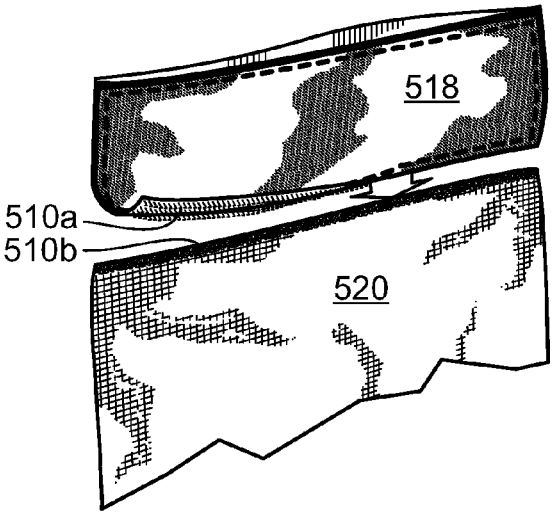

FIGS. 7*a-c* illustrate alternative embodiments of securing mechanisms for securing a recessed pocket to a main body of a towel. In particular, FIGS. 7*a-c* illustrate alternative embodiments of temporary attachment mechanisms. As indicated above, FIG. 2 illustrates one embodiment of a permanent attachment mechanism 152, namely, stitching. With reference to FIGS. 7*a-c*, FIG. 7*a* illustrates a zipper 506 utilized to secure a recessed pocket 500 to a towel body 502, FIG. 7*b* illustrates snaps 508*a-b* for securing a recessed pocket 514 to a towel body 516, and FIG. 7*c* illustrates Velcro® strips 510*a-b* for securing a recessed pocket 518 to towel body 520. Of course, alternative temporary attachment mechanisms may be employed, such as hooks or clasps. Also, the number and position of the snaps 508*a-b* and Velcro® strips 510*a-b* may be varied within the scope of the disclosed subject matter. In addition, various combinations of temporary and permanent securing mechanisms may be employed within the scope of the disclosed subject matter.

Figure 8:
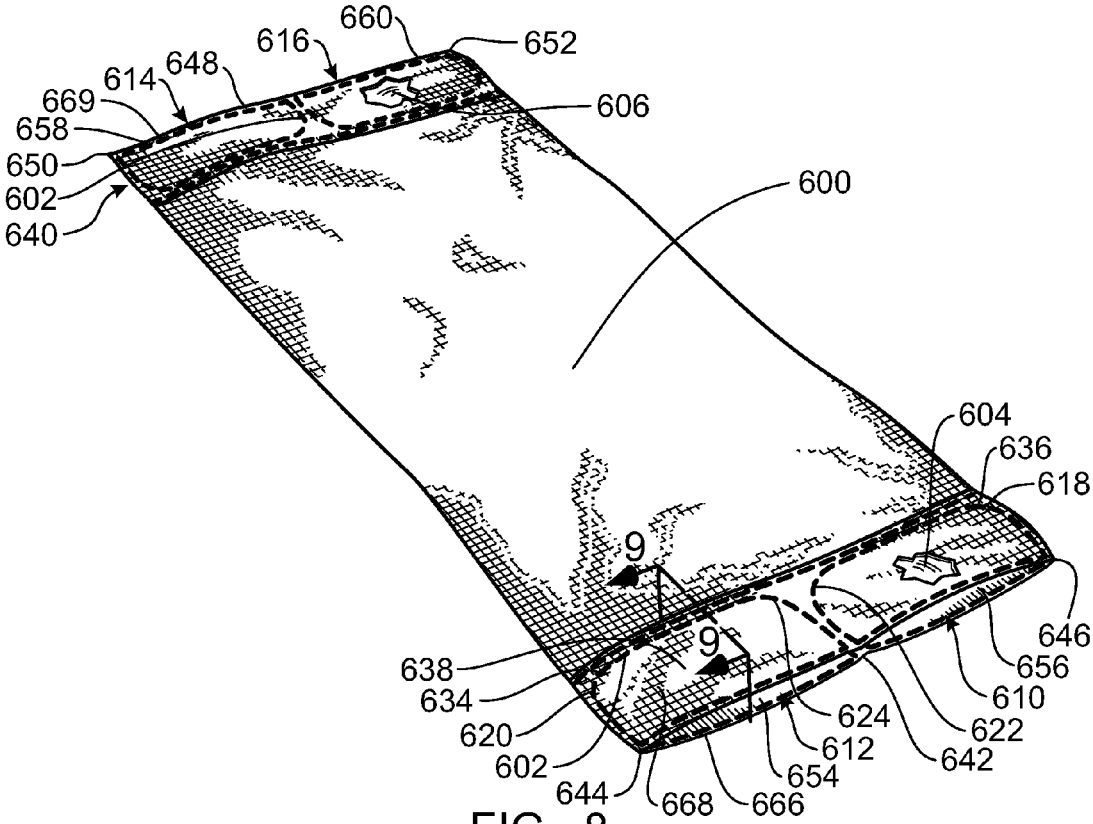
FIG. 8 illustrates an alternative embodiment of the towel.

FIG. 8 illustrates an alternative embodiment of the towel 600. The embodiment illustrated in FIG. 8 is similar to prior embodiments with the exception that the stitching pattern 602 in the respective liners 604, 606 for each pocket 638, 640 defines two or more compartments 610, 612, 614, 616. The stitching 634 in each liner 604, 606 that defines each compartment 610, 612, 614, 616 is shown in dashed lines in FIG. 8 for illustrative purposes as the stitching 634 would otherwise be obscured from view by a rectangular side 666, 668, 669 of a towel material. A portion of each rectangular side 666, 669 on each recessed pocket is cutaway in FIG. 8 (for illustrative purposes only) to show the liner 604, 606. As illustrated in FIG. 8, each compartment 610, 612, 614, 616 includes a pair of rounded corners 618, 620, 622, 624, namely, in this embodiment, a first, second, third, and fourth rounded interior corner 618, 620, 622, 624. A securing seam 634 defines or forms each set of compartments 610, 612, 614, 616 within each recessed pocket 638, 640. Each compartment 610, 612, 614, 616 corresponds to a single opening 654, 656, 658, 660 along a peripheral edge 642, 648 of the towel 600. A first peripheral edge 642 spans from a first corner 644 of the towel to a second corner 646 of the towel 600. A second peripheral edge 648 spans from a third corner 650 of the towel 600 to a fourth corner 652 of the towel 600. The second peripheral edge 648 is positioned generally opposite the first peripheral edge 642 of the towel 600.

The number of compartments 610, 612, 614, 616 within each recessed pocket 638, 640 may be varied within the scope of the disclosed subject matter. For example, in one embodiment, each recessed pocket 638, 640 includes, for example, two compartments 610, 612, 614, 616 (as illustrated in FIG. 8), or three compartments (not illustrated). Alternatively, the number of compartments 610, 612, 614, 616 within each recessed pocket 638, 640 may be different such that a first recessed pocket 638 on a particular towel 600 comprises three compartments and a second recessed pocket 640 on that same towel includes two compartments or a single compartment.

A first recessed pocket 638 having a first set of openings 654, 656 is disposed on and coextensive with the first peripheral edge 642 of the towel 600. A second recessed pocket 640 having a second set of openings 658, 660 is disposed on and coextensive with the second peripheral edge 648 of the towel 600. Having multiple compartments 610, 612, 614, 616 within each pocket 638, 640 mitigates the likelihood that the wind will blow open the recessed pocket 638, 640 and/or fold over one side of the pocket 638, 640. As illustrated in FIG. 8, when each pocket 638, 640 is open, the pertinent liner 604, 606 is visible. However, when each pocket 638, 640 is closed, the pertinent liner 604, 606 is largely or completely obscured from view.

Figure 9A:
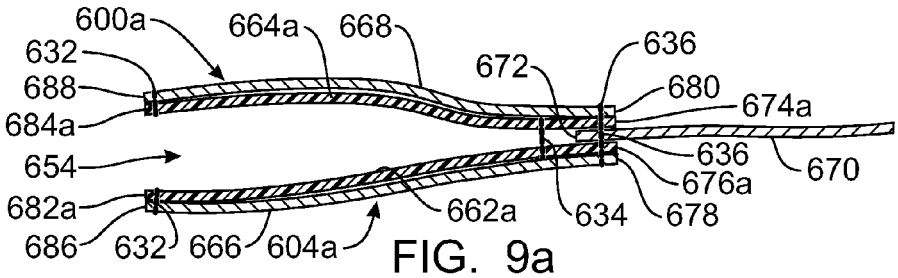
FIGS. 9*a-b* illustrate cross-sectional views of embodiments of the towel shown in FIG. 8 across the line 9-9.
Figure 9B:
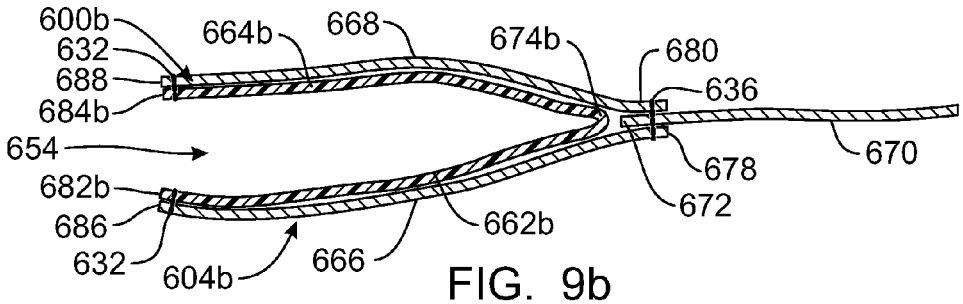

FIGS. 9*a-b* illustrate cross-sectional views of embodiments of the towel 600*a*, 600*b* shown in FIG. 8 across the line 9-9. In FIG. 9*a*, each of the two liner sides 662*a*, 664*a* comprise a separate piece of liner material and each of the sides 666, 668 of towel material comprise separate pieces of towel material. As illustrated, the distal edge 672 of the towel body 670 is secured between a closed long edge 674*a*, 676*a* of each of the two liner sides 662*a*, 664*a*, which are positioned between a closed long edge 678, 680 of each of two rectangular towel sides 666, 668 using stitching 636. In contrast, in FIG. 9*b*, the two liner sides 662*b*, 664*b* comprise a unitary, folded piece of liner material and the distal edge 672 of the towel body 670 is secured only between a closed long edge 678, 680 of each of the two rectangular sides 666, 668 of the towel material using stitching 636. The two rectangular liner sides 662, 664 are secured to each other by the stitching 636 defining the illustrated compartment. Whether formed of a unitary, folded piece or two separate pieces of liner material, the two rectangular liner sides 662*a-b*, 664*a-b*, jointly considered, comprise a liner 604*a-b*. Also, stitching 632 is utilized to secure the two rectangular sides 666, 668 of the towel material to the adjacent liner sides 662*a-b*, 664*a-b* around a mouth of the illustrated opening 654, as shown in FIGS. 9*a-b*. In other words, stitching 632 may be employed to secure an open long edge 682*a-b* of a first liner side 662*a-b* to an open long edge 686 of a first rectangular side 666 of towel material and to secure an open long edge 684*a-b* of a second liner side 664*a-b* to an open long edge 688 of a second rectangular side 668 of towel material.

Figure 10A:
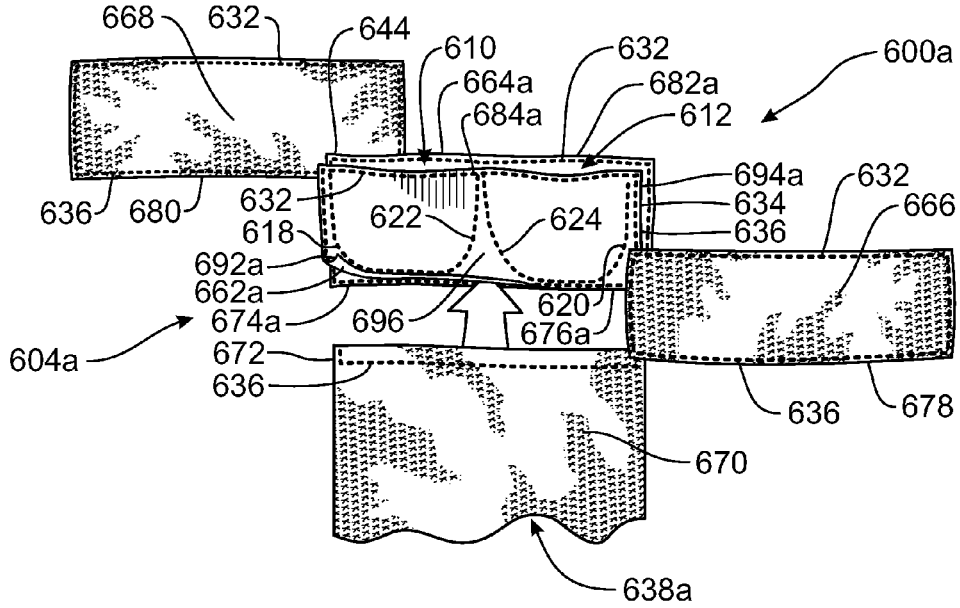
FIGS. 10*a-b* illustrate partial exploded views of embodiments of the towels shown in FIGS. 9*a-b*, respectively, and further serve to illustrate methods of making these embodiments of the towel.
Figure 10B:
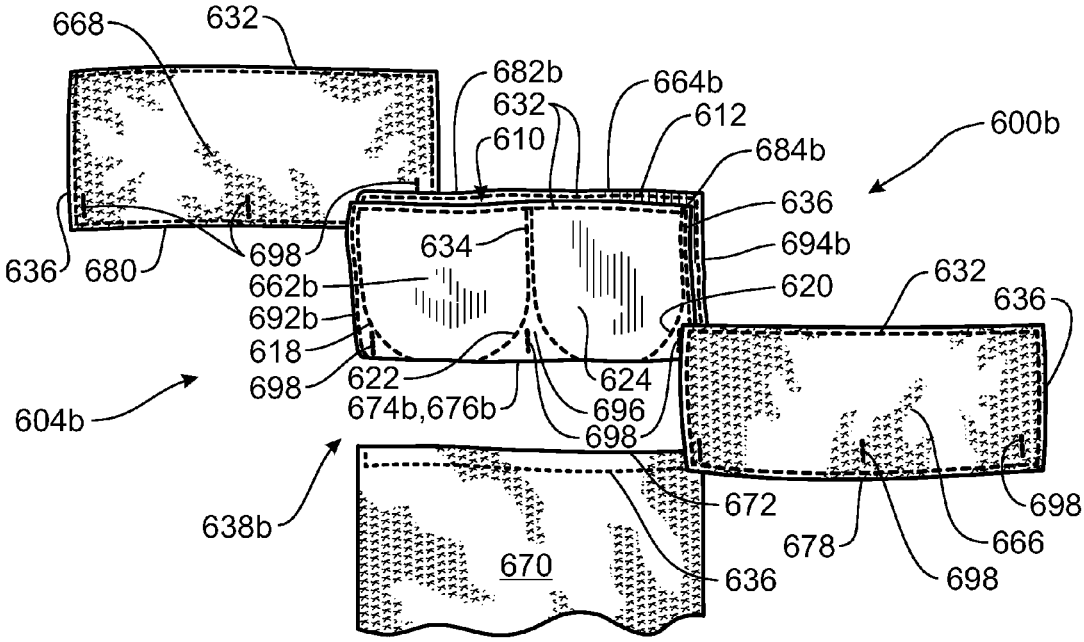

FIGS. 10*a-b* illustrate partial exploded views of embodiments of the towel 600*a-b* shown in FIGS. 9*a-b*, respectively, and further serve to illustrate methods of making these embodiments of the towel 600*a-b*. With respect to FIG. 10*a*, two sides 666, 668 of a towel material are illustrated. As shown, each of the two sides 666, 668 of a towel material comprise a separate piece of towel material. The illustrated liner 604*a* is comprised of two liner sides 662*a*, 664*a* with each liner side 662*a*, 664*a* comprising a separate piece of liner material. The dashed lines in FIG. 10*a* identify locations where stitching 632, 634, 636, or another securing mechanism, may be placed in the assembled towel 600*a*.

With respect to the liner 604*a*, stitching 632 along a long open edge 682*a*, 684*a* of each liner side 662*a*, 664*a* illustrates stitching 632 used to secure the open long edge 682*a*, 684*a* of each liner side 662*a*, 664*a* to the respective sides 666, 668 of the towel material. Stitching 634 in generally a W-shape 634 defines compartments 610, 612 within the liner 604*a*. The W-shaped stitching is comprised of the securing seam 634 that runs generally along a first short edge 692*a*, a second short edge 694*a*, and along an intermediary region 696, which, in one embodiment, may be generally parallel with the first short edge 692*a*, the second short edge 694*a*, or both. The securing seam 634 is rounded between the first 692*a* and second short edges 694*a* and the closed long edge 674*a*, 676*a* of each liner side to form a first rounded interior corner 618 and second rounded interior corner 620. The securing seam is also rounded between the intermediary region 696 and the closed long edge 674*a*, 676*a* of each liner side 662*a*, 664*a* to form a third 622 and fourth rounded interior corner 624.

The securing seam 634 further extends between the first 618 and third 622 rounded interior corners and between second 620 and fourth 624 rounded interior corners to form an enclosed end of each compartment 610, 612. A liner 604*a* is formed by the two liner sides 662*a*, 664*a* when secured to each other, as indicated above.

Two sides 666, 668 of a towel material are secured to two opposing surfaces of the liner 604*a* along a periphery of a first and second minor edges 692*a*, 694*a* of the liner 604*a* to form the first recessed pocket 638*a*. As illustrated, the stitching 636 along a periphery of the first and second minor edges 692*a*, 694*a* of the liner 604*a* are disposed outward on the liner 604*a* of the W-shaped 634 securing seam defining the compartments 610, 612. A distal end 672 of a towel body 670 is secured intermediate a closed long edge 678, 680 of the two sides 666, 668 of the towel material.

In one embodiment, as illustrated in FIG. 10*a* (and FIG. 9*a*), the distal end 672 of the towel body 670 is secured intermediate each of the closed long edges 674*a*, 676*a* of the separate pieces of liner material 662*a*, 664*a* with the distal end 672 of the towel 670 material and each of the separate pieces of liner material 662*a*, 664*a* being disposed intermediate the closed long edges 678, 680 of the two sides 666, 668 of the towel material.

With reference to FIG. 10*b*, two sides 666, 668 of a towel material are illustrated. As shown, each of the two sides 666, 668 of a towel material comprise a separate piece of towel material. The illustrated liner 604*b* is comprised of two liner sides 662*b*, 664*b* that comprise a unitary, folded piece of liner material. As with FIG. 10*a*, the dashed lines in FIG. 10*b* identify locations where stitching 632, 634, 636 may be placed in the assembled towel 600*b*.

With respect to the liner 604*b*, stitching along a long open edge 682*b*, 684*b* of each liner side 662*b*, 664*b* illustrates stitching 632 used to secure the open long edge 682*b*, 684*b* of each liner side 662*b*, 664*b* to the respective sides 666, 668 of the towel material. The stitching 634 in a generally W-shape defines compartments 610, 612 within the liner 604*b* with enclosed ends of the "W" being removed where the stitching 634 meets the folded end of the liner 604*b*. The generally W-shaped stitching 634 is comprised of the securing seam 634 that runs generally along a first short edge 692*b*, a second short edge 694*b*, and along an intermediary region 696, which is generally parallel with the first short edge 692*b*, the second short edge 694*b*, or both. The securing seam 634 is rounded between the first 692*b* and second short edges 694*b* and the closed long edge 674*b*, 676*b* of each liner side 662*a*, 664*b* to form a first rounded interior corner 618 and second rounded interior corner 620. The securing seam 634 is also rounded between the intermediary region 696 and the closed long edge 674*b*, 676*b* of each liner side 662*b*, 664*b* to form a third 622 and fourth rounded interior corner 624. A liner 604*b* is formed by the two liner sides 662*b*, 664*b* when secured to each other, as indicated above.

Two sides 666, 668 of a towel material are secured to two opposing surfaces of the liner 604*b* along a periphery of a first and second minor edges 692*b*, 694*b* of the liner 604*b* to form the first recessed pocket 638*b*. As illustrated, the stitching 636 along a periphery of the first and second minor edges 692*b*, 694*b* of the liner 604*b* are disposed outward of the W-shaped securing seam 634 defining the compartments 610, 612. A distal end 672 of a towel body 670 is secured intermediate a closed long edge 678, 680 of two sides 666, 668 of the towel material.

The embodiment illustrated in FIG. 10*b* may employ stitching groups 698 to secure the liner 604*b* within the recessed pocket 638*b*, i.e., such that the liner 604*b* cannot be folded out from the recessed pocket 638*b* unless the stitching groups 698 are broken. The stitching groups 698, for example, could be placed between the lines of stitching 634 in the intermediate region 696, between the third 622 and fourth 624 interior rounded corners and/or adjacent to a first minor edge 692*b* or a second minor edge 694*b* of the liner 604*b* (such as between the first rounded interior corner 618 and the first minor edge 692*b* or between the second rounded corner 620 and the second minor edge 694*b*). A stitching group 698 may comprise a single stitch or multiple stitches. The stitching groups 698 may include rivets, stitching, and/or other attachment mechanisms. The stitching groups 698 secure the liner 604*b* to one or more of the two sides 666, 668 of the towel material.

Figure 11:
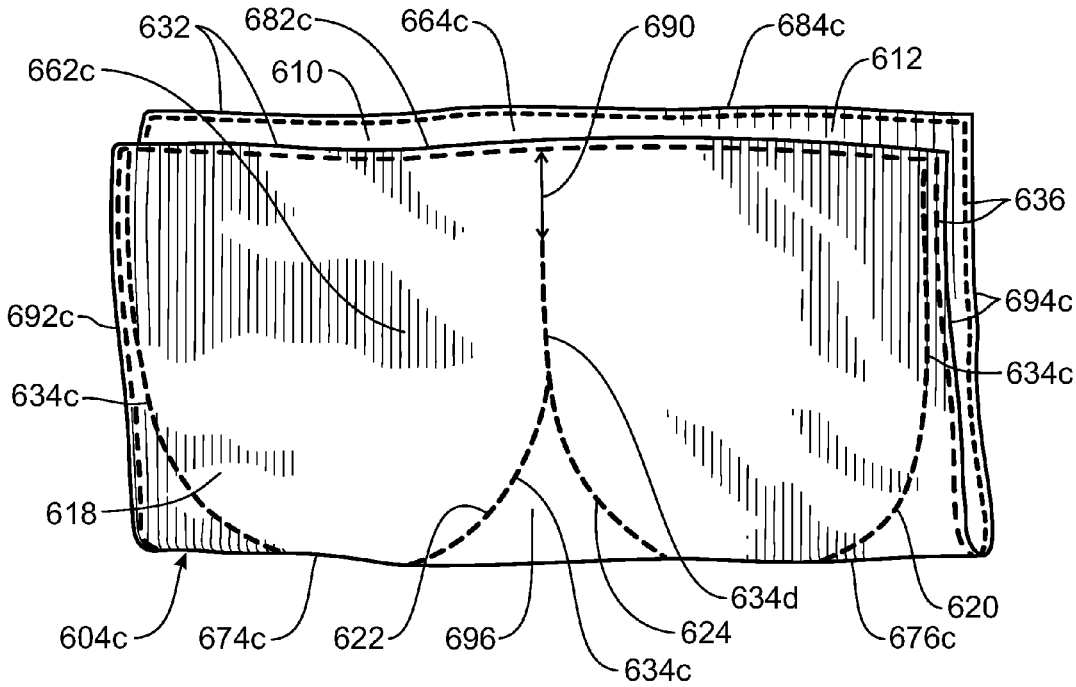
FIG. 11 illustrates an alternative embodiment of a liner.

FIG. 11 illustrates an alternative embodiment of a liner 604*c*. The stitching 634*c* in generally a W-shape defines compartments 610, 612 within the liner 604*c* with enclosed ends of the "W" being absent where the stitching 634*c* meets the folded end of the liner 604*c*. The generally W-shaped stitching 634*c* is comprised of the securing seam 634*c* that runs generally along a first short edge 692*c*, a second short edge 694*c*, and along an intermediary region 696, which is generally parallel with the first short edge 692*c*, the second short edge 694*c*, or both. The securing seam 634*c* is rounded between the first and second short edges 692*c*, 694*c* and the closed long edge 674*c*, 676*c* of each liner side 662*c*, 664*c* to form a first rounded interior corner 618 and second rounded interior corner 620. The securing seam 634*c* is also rounded between the intermediary region 696 and the closed long edge 674*c*, 676*c* of each liner side 662*c*, 664*c* to form a third and fourth rounded interior corner 622, 624. As illustrated in FIG. 11, the stitching 634*c* along the intermediary region 696 merges into a single line of stitching 634*d* (a "merged securing seam") where the third and fourth rounded interior corners 622, 624 meet. In addition, the stitching 634*d* that runs along the intermediary region 696 does not extend fully to the open major edge 682*c*, 684*c* of the liner 604*c*, thus forming a gap 690. The gap 690 serves to mitigate the visibility of the compartments 610, 612 and stitching 636 within a recessed pocket 638 and, in certain embodiments, may be approximately 1 inch length or may be approximately ⅛ to ¼ of the length of the first short edge 692*c* of a liner side 662*c*.

Both the gap 690 and the merged securing seam 634*d* can be used in connection with any of the embodiments illustrated, for example, in FIGS. 8, 9, 10*a-b*.

Various attachment mechanisms, such as rivets, adhesives, ultrasonic welding, may be used in lieu of and in conjunction with the stitching illustrated throughout this application. For example, in adhesives may be utilized to secure the two rectangular liner sides to the proximate rectangular sides of the towel material in lieu of or in conjunction with stitching around the mouth of the illustrated opening.

The towel material disclosed herein may be embodied in various ways and may be, for example, a cotton or terry cloth material. In one embodiment, the liner may be impervious to sand, washable, and water resistant or waterproof. For example, the liner may be fabricated from a nylon material, polyester material, a polymer material, or a combination of the foregoing.

Each securing seam disclosed herein may comprise a single continuous seam in one embodiment or a series or set of disjunct seams in an alternative embodiment.

Each liner discussed above may include a different number of compartments, such as one, two, or three or more compartments, although only two are illustrated in FIGS. 8, 9, 10*a-b*, and 11. In addition, the number of compartments formed on each recessed pocket of a particular towel may be different or the same.

In connection with all embodiments disclosed herein, different types of liner and towel material may be employed to fabricate the towel. In addition, one or more of the temporary and permanent attachment mechanisms of, for example, FIGS. 6*a-d* and 7*a-c* may be implemented in connection with each of the disclosed embodiments.

While specific embodiments and applications of the present invention have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention.

What is claimed is:

1. A method of manufacturing a recessed pocket of a towel, the method comprising:

securing to each other two coextensively positioned liner sides generally along a first short edge, a second short edge, and a long closed edge of each of the liner sides to form a liner using a securing seam, the securing seam being rounded between the first and second short edges of each liner side and the closed long edge of each liner side; and securing each of two sides of a towel material to two opposing surfaces of the liner along a periphery of a first and second minor edges of the liner to form a first recessed pocket.

2. The method of claim 1, further comprising securing each of the two sides of the towel material to the two opposing surfaces of the liner along a periphery of a closed major edge of the liner.

3. A method of manufacturing a towel, the method comprising:

securing to each other two coextensively positioned liner sides generally along a first short edge, a second short edge, and along an intermediary region that is generally parallel with the first short edge to form a liner using a securing seam, the securing seam being rounded between the first and second short edges and a closed long edge of each liner side to form a first and second rounded interior corner, the securing seam also being rounded between the intermediary region and the closed long edge of each liner side to form a third and fourth rounded interior corner;

securing each of two sides of a towel material to two opposing surfaces of the liner along a periphery of a first and second minor edges of the liner to form a recessed pocket; and securing a distal end of a towel body intermediate the two sides of the towel material.

4. The method of claim 3, wherein the two liner sides each comprise a separate piece of liner material.

5. The method of claim 4, further comprising securing the distal end of the towel body intermediate each of the separate pieces of liner material, the distal end of the towel material and each of the separate pieces of liner material being disposed intermediate the two sides of the towel material.

6. The method of claim 4, wherein the securing seam extends between the first and third rounded interior corners and between second and fourth rounded interior corners.

7. The method of claim 3, wherein the two liner sides comprise a unitary, folded piece of liner material.

* * * * *